US005104043A

United States Patent [19]

Pacht

[11] Patent Number: 5,104,043

[45] Date of Patent: Apr. 14, 1992

[54] MAGNETIC SPEED CONTROL FOR SELF-PROPELLED SWIVEL

[75] Inventor: Amos Pacht, Houston, Tex.

[73] Assignee: Butterworth Jetting Systems, Inc., Houston, Tex.

[21] Appl. No.: 585,226

[22] Filed: Sep. 19, 1990

Related U.S. Application Data

[63] Continuation-in-part of Ser. No. 467,782, Jan. 19, 1990, Pat. No. 5,060,862.

[51] Int. Cl.[5] ..... B05B 3/06

[52] U.S. Cl. ..... 239/128; 239/132; 239/252

[58] Field of Search ..... 188/264 D, 264 F, 264 CG, 188/269; 239/225.1, 252, 128, 132

[56] References Cited

U.S. PATENT DOCUMENTS

| | | | |
|---|---|---|---|
| 2,264,914 | 12/1941 | L'Orange | 239/132.5 |
| 3,063,532 | 11/1962 | Jueschke | 188/264 P X |
| 3,469,665 | 9/1964 | Murata et al. | 188/264 P X |
| 3,648,814 | 3/1972 | Barron | 188/264 P X |
| 3,987,963 | 10/1976 | Pacht | 239/124 |
| 4,439,954 | 4/1984 | Bennett | 51/411 |
| 4,561,605 | 12/1985 | Nakajima | 242/845.2 |
| 4,690,325 | 9/1987 | Pacht | 239/124 |
| 4,700,891 | 10/1987 | Hans et al. | 234/132.5 |
| 4,704,826 | 11/1987 | Kirkland | 51/411 |
| 4,763,033 | 8/1988 | Charbonnier | 310/105 |
| 4,821,961 | 4/1989 | Shook | 239/253 |

FOREIGN PATENT DOCUMENTS

| | | | |
|---|---|---|---|
| 65549 | 8/1947 | Denmark | 239/225.1 |
| 2217234A | 10/1989 | United Kingdom . | |
| 2221630A | 2/1990 | United Kingdom . | |

*Primary Examiner*—Andres Kashnikow
*Assistant Examiner*—Kevin P. Weldon
*Attorney, Agent, or Firm*—Jones, Day, Reavis & Pogue

[57] ABSTRACT

In a self-propelled swivel for directing high pressure streams of water in a rotary path against a surface to be cleaned, a plurality of permanent magnets are mounted on a rotary cage and rotate in close proximity to a sleeve of electrically conductive material, generating eddy currents in such sleeve and hence heating the sleeve. Low pressure water leaking through a seal provided in the path of the high pressure water is diverted to cool the portion of a casing surrounding the heated electrically conductive sleeve to provide braking of the rotational speed of the rotating nozzle heads without creating excessive localized heating within the housing.

8 Claims, 3 Drawing Sheets

MAGNETIC SPEED CONTROL FOR SELF-PROPELLED SWIVEL

RELATIONSHIP TO OTHER CO-PENDING APPLICATION

This application constitutes a continuation-in-part of application Ser. No. 467,782, filed Jan. 19, 1990, now U.S. Pat. No. 5,060,862, which is incorporated herein by reference.

FIELD OF THE INVENTION

This invention relates to a high pressure fluid delivery system which includes a swiveling element which swivels in response to reaction forces from fluid flow.

BACKGROUND OF THE INVENTION

In the prior art, fluid systems are provided in which a high pressure stream of water, i.e., at pressures of 6,000 to 10,000 pounds or more, are used for many cleaning applications. In some of these systems one or more hand-held valve assemblies or guns are provided, and are connected by a hose to a common outlet of a pump. The guns generally include a housing having a valve therein, a barrel extension for directing the high pressure stream or water through a nozzle to the object to be cleaned, a handle or trigger mechanism for operating the valve, and a relatively unrestricted pressure relief or "dump" outlet for relieving pressure in the assembly when flow through the high pressure nozzle outlet is interrupted by operation of the valve.

In some applications it is desired to have a vertically suspended mechanism. Theses contain a stationary, hollow housing defining an enlarged opening in the top end for receiving a sealing structure for connection to a source of high pressure fluid, such as water, which may contain cleaning agents. A hollow spindle is journaled in the lower portion of the hollow housing and provides an axial passage for the high pressure fluid. A head secured to the lower end of the rotatable spindle defined fluid passages leading to one or more outlets in the form of nozzles which provide a high pressure generally downwardly directed spray for cleaning a surface or object. In order to avoid spot treatment and promote uniformity the outlet nozzles are generally slightly angled off the vertical axis of the device which, through reaction forces, creates a turning moment which causes the rotatable element to rotate in response to the reaction forces generated when the fluid is flowing.

A problem is encountered because on the one hand it is desirable to have minimum friction operating on the rotatable spindle so as to assure steady rotation of the hollow spindle in order to maintain the spray in a generally downward direction without excessive angulation off the vertical, and yet provide sufficient friction so that the rotatable element does not overspeed and turn at excessive speeds which will rapidly destroy the bearings. The reaction forces are difficult to estimate and it is difficult to balance the combination of frictional forces and reaction forces so that the rotatable portion of the housing containing the nozzles will steadily rotate but will not reach an excessively high speed.

It was discovered that the incorporation of a specially constructed magnetic rotor assembly on the rotatable spindle prevents the rotating mechanism from accelerating to an undesirably high speed but does not otherwise affect the operation. The magnetic rotor assembly includes permanent magnets which do not require the use of a battery.

Further experimentation with the aforementioned magnetic rotor assembly on the rotatable spindle reveals the fact that the magnetic rotor assembly would, at very high speeds, develop excessive heat due to the eddy currents created by the rotating magnets. Such localized heat can create distortion of the housing or spindle which can result in deterioration of the bearings of the apparatus and demagnetize the magnetic elements.

SUMMARY OF THE INVENTION

The basic self-propelled swivel for high pressure water applications in vertical orientation is set forth in my U.S. Pat. No. 4,690,325, issued Sept. 1, 1987, entitled "High Pressure Fluid Delivery System," which is incorporated herein by reference. This basic structure has been modified by providing a magnet rotor assembly fixed to the rotatable spindle portion of the swivel assembly. The magnet rotor assembly is specially designed to fit between the upper and lower bearings which rotatably support the rotatable spindle. The magnet rotor assembly has a cylindrically-shaped cage having a central opening which is installed by interference fit on the spindle shaft. The cylindrically-shaped cage is non-magnetic and contains radially oriented bores, preferably circumferentially spaced at 45° intervals into which are placed cylindrical permanent magnets. In order to multiply the effect there are preferably two sets of radially oriented bores, one located directly above the other, all of which are spaced apart at 45° angles, the axes of which are perpendicular to the axis of the spindle. The outside periphery of the cylindrically-shaped cage containing the magnets is enclosed by cylindrical ring cover. Both the cage and the cylindrical ring cover are formed of non-magnetic materials. The non-rotating part of the housing adjacent the cylindrical ring cover mounts a thin cylindrical ring or sleeve made of electrically conducting material pressed in the housing, which does not rotate. There is a small air gap between the conductive ring and the cylindrical ring cover so that the caged magnets and cover ring can rotate freely in close proximity to the stationary conductive sleeve.

In addition to providing a holder for the magnets the cylindrically-shaped cage serves as a support which holds the upper bearing race in position on the spindle. The lower bearing is positioned by the opposite bore end of the cylindrically-shaped cage and held in position by a cap on the lowermost portion of the non-rotatable housing.

When fluid pressure is applied, the spaced apart exit nozzles are slightly angled to effect rotation of the spindle. The rotating spindle and cylindrically-shaped cage containing the magnets generate eddy currents in the conducting material of the sleeve which generate magnetic fields believed to interfere with the magnetic fields produced by the permanent magnets. The interfering magnetic fields increase with accelerating speed and so reach an equilibrium rotational velocity at a particular set of operating conditions. Thus the spindle is allowed to rotate but is controlled in its rotation below the ultimate speed which it would reach absent the magnets.

Further experimentation has revealed the fact that when the aforedescribed magnetic braking apparatus is employed with a spindle rotating at significantly high speeds, the eddy currents generated in the electrically conductive material of the ring or sleeve results in the generation of excessive localized heat which tends to warp the housing and thus misalign the bearings contained in the housing, thus leading to early deterioration of the bearings and demagnetize the magnetic elements.

In accordance with this invention, means are provided for minimizing the heating of the electrically conductive ring or sleeve through the application of cooling fluid. Such cooling fluid is diverted from the high pressure fluid supplied to operate the swivel, but the diverted cooling fluid is not subject to the high pressure of the primary fluid. Instead, the seal construction provided between the rotating spindle and the stationary housing is designed to permit a small amount of fluid leakage, and this leakage fluid is diverted into heat exchange contact with the electrically conductive ring or sleeve in which the braking eddy currents are generated.

In one embodiment of the invention, an annular fluid passage is provided around the exterior of that portion of the stationary housing which mounts the electrically conductive sleeve or ring.

In another embodiment of the invention, the entire magnetic braking assembly is incorporated in a housing separate from the spindle mounting housing but disposed in parallel, adjacent relationship thereto. Gearing means are provided between the rotating spindle and a parallel axial shaft rotatably mounted in the second housing which drives a cage containing magnets which are disposed in peripherally spaced relationship, with the end faces closely adjacent to an electrically conductive sleeve. Thus, the magnets may be rotated at a speed substantially greater than that of the spindle and a substantially greater magnetic braking action may be produced. Water leaking through the seal structure provided in the spindle mounting housing is directed to a plurality of ports to impact against the side of the second housing and provide cooling of the second housing.

A further feature of this last mentioned modification is the mounting of a magnetic sleeve in concentric, secured relationship to the electrically conductive non-magnetic sleeve and the provision of means for manually adjusting the axial position of the magnetic sleeve relative to the rotating permanent magnets. This permits the degree of magnetic braking action to be conveniently adjusted, either before or during the actual operation of the rotating swivel.

Further objects and advantages of the invention will be readily apparent to those skilled in the art from the following detailed description, taken in conjunction with the annexed sheets of drawings, on which is shown two preferred embodiments of this invention.

DETAILED DESCRIPTION OF THE INVENTION

Figure 1:
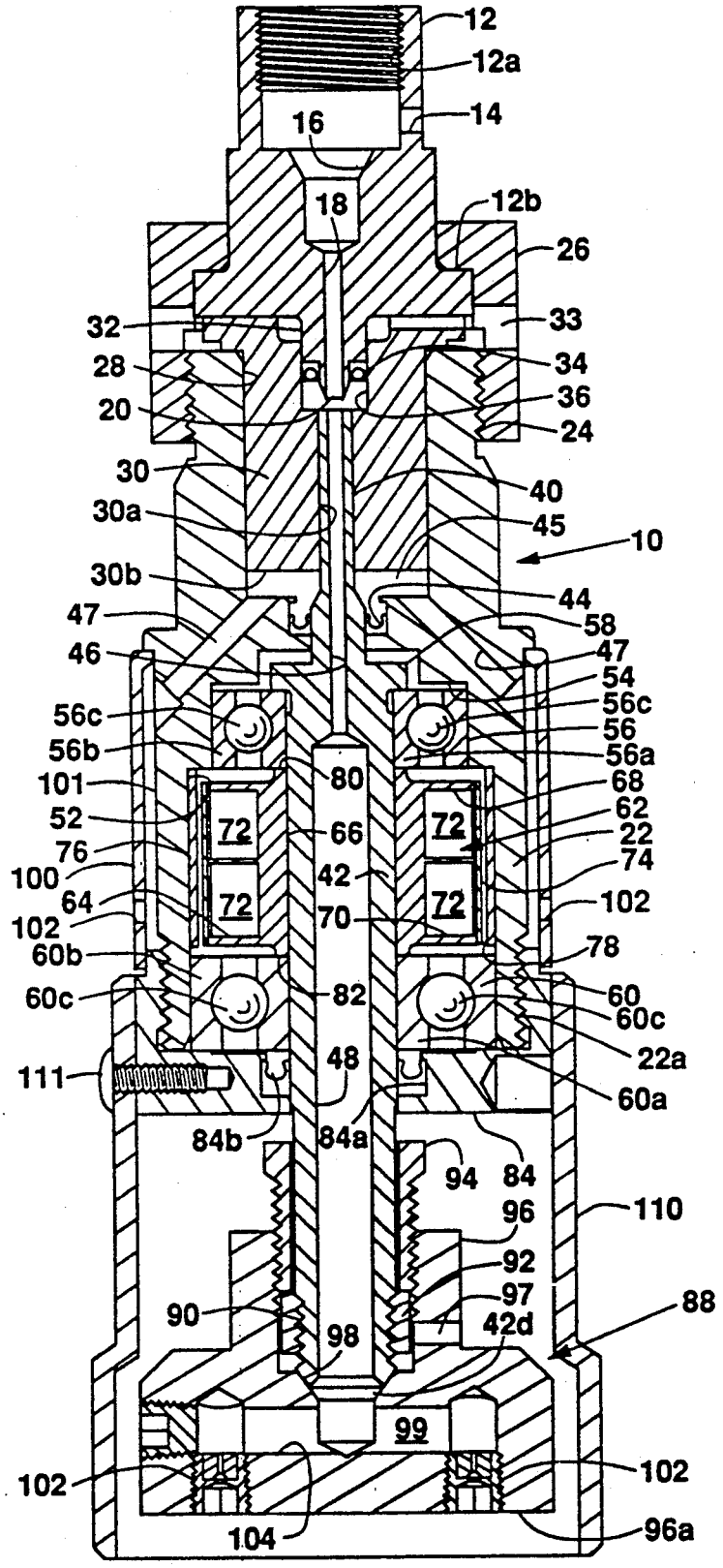
FIG. 1 is a vertical cross-section through the center of a housing and a self-rotating spindle with the elements thereof shown in their normal operating positions.

Referring to FIG. 1, there is shown a fluid propelled swivel assembly generally designated by the reference numeral 10 which incorporates a magnetic speed control. The swivel 10 is very similar to the apparatus identified by the corresponding number in my above identified parent application, and reference numerals utilized in this description correspond, wherever possible, to similar structures employed in the parent application.

A non-rotating upper housing member 12 has an internally threaded inlet **12*a* for connection to a source of high pressure fluid. The inlet is connected through high pressure lines or hoses to a suitable high pressure pump and a source of fluid (generally water) to be pressurized and fed to the inlet of the swivel assembly 10. The fluid to be utilized is normally water or water containing detergents or other cleaning additives or solutions. The assembly 10** is similar to the high pressure fluid delivery system shown in the U.S. Pat. No. 4,490,325, except for the departures therefrom which constitute the improvements of this application.

Upper housing 12 has a "weep" opening 14 for pressure relief. "Weep" openings 33 and 97 are also provided in other parts of the assembly and they are understood by those skilled in the art as providing outlets for small amounts of leakage at connections or through seals to prevent pressurizing enclosed portions of the swivel structure. Special high pressure thread connections are used.

Upper housing 12 has a centrally disposed flared bore 16 which leads to a vertical fluid passageway 18 which terminates in an outlet 20. Swivel assembly 10 further includes a lower nonrotating, hollow housing 22 which has an upwardly extending threaded portion 24. A threaded assembly ring 26 engages a shoulder **12*b* on upper housing 12 and simultaneously engages threaded portion 24 to join the upper and lower housings 12 and 22 securely together. As stated, housings 12 and 24 are non-rotatable elements. Upper portion 24 of lower housing 22 has a large diameter bore 28 which is closely fitted with a seal cartridge 30 which has the same purposes and characteristics as illustrated in FIG. 1 of U.S. Pat. No. 4,690,325. A downwardly protruding tip portion 32 of upper housing 12 extends into and seals with the wall of a chamber 36 defined in the upper portion of seal cartridge 30. An upper seal 34 provides a seal between the downwardly protruding tip portion 32 and the interior chamber 36, centrally located in seal cartridge 30. Outlet 20 of upper housing 12 thus communicates with chamber 36**.

Upwardly protruding into communication with chamber 36 is a tubular projection 40 of a hollow spindle 42. Spindle 42 along with tubular projection 40 are rotatable. Tubular projection 40 is tightly fitted in a central bore **30*a* in seal cartridge 30 to provide minimum clearance that would still permit rotation of the spindle 42 relative to the seal cartridge 30. Tubular projection 40 is further sealed by a lower seal element 44. Seal element 44 thus cooperates with the bottom face 30*b* of seal cartridge 30 to define a chamber 45 within which fluid leaking through the minimal clearance provided between spindle projection 40 and the seal cartridge 30 may be collected. This leakage water is then dispensed radially and downwardly outwardly through a plurality of peripherally spaced ports 47** for a purpose to be hereinafter described.

It should be noted that the purpose of seal 44 is not to prevent the application of the high pressure to lower portions of the apparatus inasmuch as this is effectively prevented by the minimum clearance fit between the tubular spindle projection 40 and the seal cartridge 30.

Instead, the function of seal 44 is to merely prevent downward flow of any leakage fluid which enters the chamber 45.

In contrast, the upper chamber 36 is exposed to the full pressure of the high pressure fluid entering the apparatus and thus the high pressure liquid enters the bore 46 of the hollow spindle 42.

Stationary housing 22 further defines an internal chamber 52 which is cylindrical in shape and has a downwardly facing shoulder 54 for securing an upper anti-friction bearing 56. Bearing 56 may be a conventional sealed ball bearing unit having inner and outer races 56*a* and 56*b* and ball elements 56*c*. Upper bearing 56 supports spindle 42 for rotation. An enlarged diameter shoulder 58 on spindle 42 engages the inner race 56*a* of bearing 56 for thrust support. Spindle 42 is also supported in housing 22 by an enlarged lower bearing 60 having an inner race 60*a* , and outer race 60*b* and ball elements 60*c*. Bearings 56 and 60 are preferably radially sealed ball bearings which, in contrast with U.S. Pat. No. 4,690,325, do not need separate external lubrication.

The bottom end of stationary housing 22 is provided with external threads 22*a* which are engaged by a cup-shaped retaining ring 84 which has a base portion extending transversely across the bottom face of stationary housing 22 and defining a seal chamber 84*a* adjacent to the exterior of the spindle 42. A seal element 84*b* effects a fluid seal between the retaining ring 84 and the rotatable spindle 42.

The extreme lower end of hollow spindle 42 projects downwardly out of the retaining ring 84 and has external threads 90 formed on its bottom portion. Threads 90 are utilized to secure a nozzle block generally designated 88 in sealed relationship on the lowermost end of spindle 42. A nut 92 is threaded onto threaded portion 90. A threaded fitting 94 slides over spindle 42 and mounts an internally threaded head 96. Below the threads of head 96 is a chamber 98 which is flared as indicated to seat against the tapered end 42*d* of spindle 42 in sealing relationship. Chamber 98 has at least one passageway 99 leading to at least one downwardly directed nozzle 102. Nozzles 102 are of conventional configuration and are threadably inserted in appropriate threaded bores provided in the bottom end face 96*a* of head 96. An additional passageway 104 connects between chamber 98 and a second nozzle 102 which is screwed into head 96.

As described in my aforementioned parent application, at least one of the nozzles 102 is disposed in a slight annular relationship to the vertical so as to create a reaction force torque which causes the rotation of spindle 42. The self-propelled rotation of the rotating swivel components on spindle 42 could accelerate to such a degree that vibration and various other forces would actually destroy the swivel assembly. To apply a braking action to the rotation of the spindle 42, the stationary housing 22 is provided with the internal chamber 52 intermediate the anti-friction bearings 56 and 60. This enlarged chamber accommodates a magnet rotor assembly generally designated 62 which is secured to spindle 42 for co-rotation just below upper bearing 56. A cylindrically shaped cage 64 formed of non-magnetic material has a central bore 66 which is press fitted to spindle 42. The cage 64 has two rows of radially oriented bores preferably circumferentially spaced apart at 45° angles around the periphery of cage 64, with the bores of one row being disposed immediately above the bores of the other. The upper set of bores are designated 68 and the lower set of bores are designated 70. Consequently there are eight pairs of bores 68, 70 spaced apart on radial axes perpendicular to the central axis of spindle 42 at 45° intervals around the circumference of cage 64.

Into each of the bores 68, 70 and cylindrical cage 64 are fitted cylindrical permanent magnets 72 which are formed of a strong high magnetic energy material. Magnets 72 have their poles respectively determined by their opposed end faces and they are held in position by a cylindrical ring cover 74, which is formed of a non-magnetic material. Ring cover 74 is preferably press fitted around the outer periphery of the cylindrically shaped cage 64, thus covering the outside openings of bores 68 and 70 and retaining the magnets 72 in the cage 64.

The poles of the magnets 72 in each stacked pair of bores 68, 70 are the same, i.e., either north or south. The poles must alternate with respect to the adjacent stacked pair of magnet holding bores 68, 70. To put it another way, the magnetic poles alternate between north and south orientation around the circumference of the cage 64.

Interferingly fit in the internal chamber 52 of housing 22 is a cylindrical sleeve or ring of non-magnetic, electrically conductive material 76 which is placed in close proximity to the external surface of cylindrical ring cover 74 of the magnet rotor assemblies 62. There is thus a small air gap 78 between the inside surface of conducting ring 76 and the outside surface of magnet rotor assembly 62.

Each end of the cylindrically shaped magnet cage 64 is provided with bosses 80 and 82 adjacent its internal bore. When assembly 62 is interference fit on spindle 42, it slides up against and secures the inner race 56*a* of upper bearing 56 against shoulder portion 58 of spindle 42. Lower bearing 60 is located on the spindle 42 with its inner race in contact with the lower boss 82 and is held in place by the threaded retaining ring 84.

With the exception of the leakage fluid passages 47, the swivel assembly 10 heretofore described is substantially identical to that shown in my above identified parent application. A different structure is provided in the form of an external sleeve 100 which is secured in surrounding, radially spaced relationship to the medial portion of the rotatable housing 42 by cooperating shoulders provided on housing 22 and retaining ring 84. The outer sleeve 100 thus defines an annular fluid passage 101 surrounding that portion of the stationary housing 22 within which the electrically conductive sleeve 76 is mounted. Leakage fluid entering the ports 47 pass downwardly through the annular passage 101 and effect the cooling of the exterior of the medial portion of stationary housing 22. Such fluid is then discharged through radial ports 102 provided at the bottom end of the outer sleeve 100.

Additionally, a shroud 110 is provided which is of cylindrical configuration and fits snugly around the bottom end of retaining ring 84 and is secured thereto by one or more bolts 111. The shroud 110 is outwardly enlarged at its bottom end to surround the head 96 which contains the nozzles 102 in radially spaced relationship thereto. The shroud 110 functions to prevent the spraying of particles loosened by the high pressure water jets issuing from nozzles 102.

In operation, pressurized fluid enters the inlet 12*a*, passes through chamber 16, passageway 18, chamber 36, central opening 46, central bore 48, chamber 98, passageways 99, 104 and exits through nozzles 102.

FIG. 1 shows two equally spaced nozzles although it is possible to use only one nozzle or more than two nozzles. The head 96 is replaceable not only to replace worn or damaged nozzles but also to select a head with a more appropriate angle of the nozzle from the vertical. The amount of rotational force generated by the passage of fluid through the assembly 10 will depend not only upon the number of nozzles and the angle of the axis of the nozzle from the vertical, but also by the amount of friction in the assembly and especially by the size of the openings in the nozzle and the amount of pressure applied to the pressurized fluid. It must be appreciated that pressures as high as 20,000 pounds per square inch are utilized in this type of high pressure swivel which change the rotational torque generated.

The seal cartridge is preferably made from an aluminum bronze metal and the spindle is made from magnetic stainless steel. The cylindrically-shaped cage and the cylindrical ring cover of the magnetic rotor assembly are made from a non-magnetic material, preferably aluminum. The conducting material in ring 76 is made of copper which is pressed into the housing. Applicant believes the better conductivity of copper as compared to bronze is desirable. In the particular embodiment illustrated in FIG. 1 the copper sleeve 76 was about 1/16 inch thick with an outer diameter of about 1 and 3/16 inches. The air gap between the cylindrical ring of conducting material and the outer circumference of the surface of the magnetic rotor assembly should be as close as possible without rubbing. A small air gap of approximately 0.02 inches has been found satisfactory. An enlarged lower bearing 60 has been provided to better accommodate the thrust and still use a radial bearing which does not need an external lubrication system. It is desirable to use strong magnets in the magnetic rotor assembly in order to maintain the compactness of the unit. Neodymium magnets have been used successfully although they are somewhat sensitive to heat generated, and less heat sensitive magnets would be desirable. A high energy magnet is desirable. The strong magnets make a more compact assembly possible.

It is believed that the magnetic braking action arises because of eddy currents generated which create magnetic fields in opposition to the fields of the permanent magnets and in this regard it should be noted that the lower housing 22 is made of magnetic material. The exact mechanism of the magnetic braking provided by the magnetic rotor assembly is not completely understood. The beauty of the action of the magnetic rotor assembly is that the magnetic braking increases automatically as the rotational speed increases, which generates an increasing counter torque to the torque provided by the nozzles, presumably because more eddy currents are generated. Consequently the unit reaches an equilibrium rotational velocity and stays constant for a particular set of operating conditions.

From the foregoing description, it will be readily apparent that the construction of Figure I provides a convenient and economical arrangement for absorbing any excess heat produced by eddy currents generated in the electrically conductive sleeve 76 by the rotating magnets 72.

Figure 2:
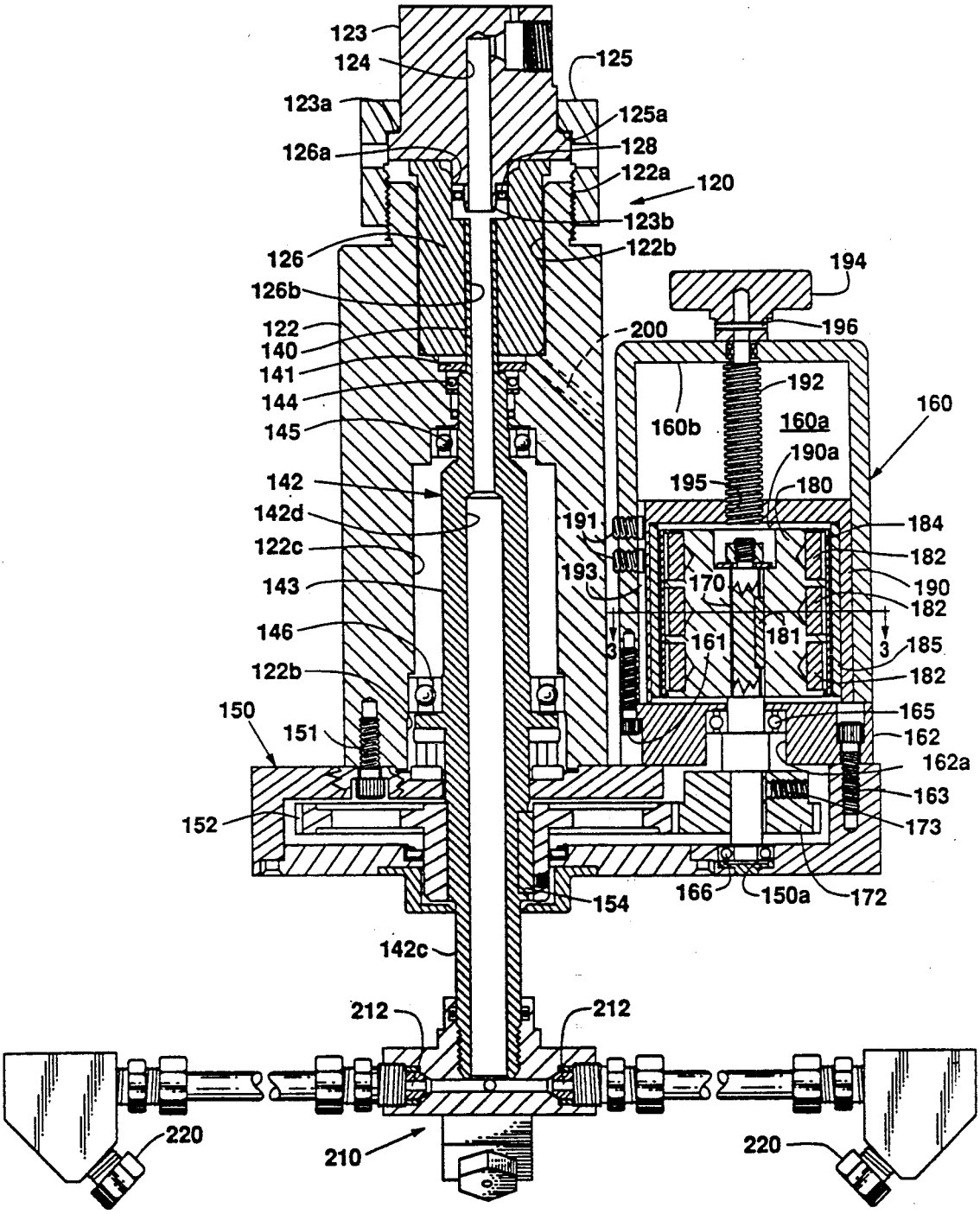
FIG. 2 is a vertical cross-sectional view of a modified fluid operated rotating swivel utilizing a second housing for the mounting of a magnetic braking mechanism.
Figure 3:
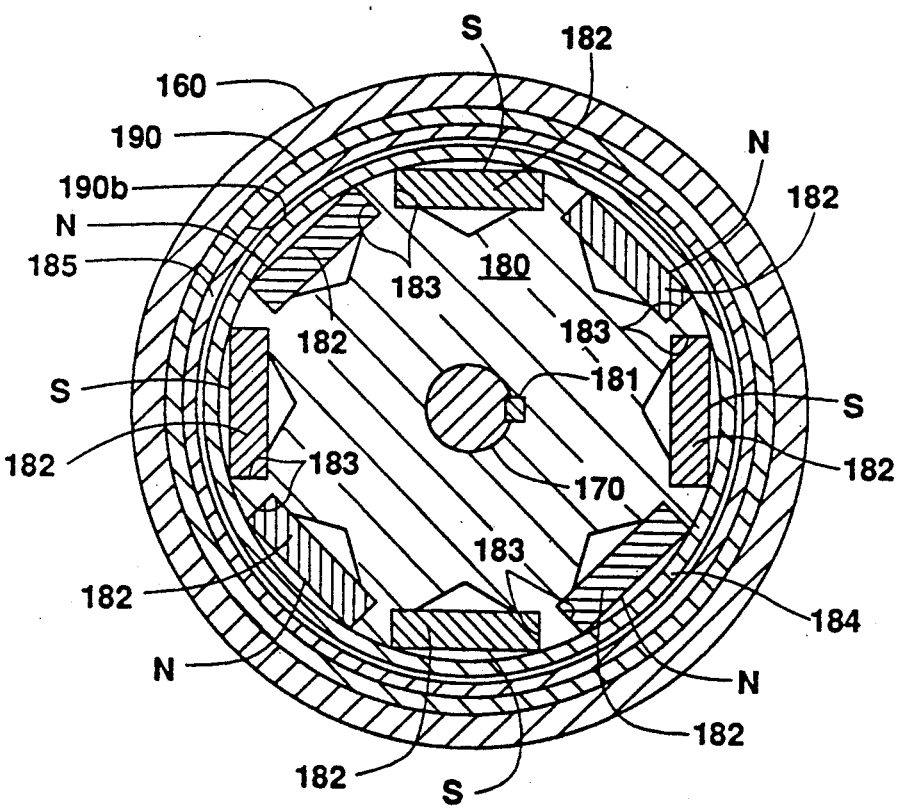
FIG. 3 is a sectional view taken on the plane 3–3 of FIG. 2 illustrating the arrangement of the magnetic elements relative to the electrically conductive sleeve.

A further embodiment of this invention is illustrated in FIGS. 2 and 3 designated generally by reference numerals 120. In this embodiment, a stationary hollow housing 122 is provided having an upper inlet housing 123 defining a passageway 124 for introducing high pressure fluids into the interior of the stationary housing 122. Upper housing 123 is secured to stationary housing 122 by an assembly ring 125 which has a downwardly facing shoulder 125*a* engaging an upwardly facing shoulder 123*a* on the inlet housing 123 and is threadably engaged with threads 122*a* formed on the top end of the stationary housing 122.

A seal element 126 constructed in substantially the same manner as the seal element 30 of Figure 1 is mounted within a counterbore 122*b* formed in the stationary housing 122 and is clamped in position by the assembly ring 125. A downwardly projecting protuberance 123*b* is provided on the bottom end of the inlet housing 123 and projects into a counterbore 126*a* formed in the top end of the seal element 126 and is sealed by seal 128.

Seal element 126 further defines a reduced diameter bore 126*b* within which is snugly mounted, with minimal clearance permitting rotation, the upper stem portion 140 of a hollow spindle 142. Hollow spindle 142 is additionally supported for rotation in the stationary housing 122 by a pair of anti-friction bearings 144 and 145 the inner races of which respectively are secured to an upper medial portion of the hollow spindle 142.

The lower medial portion 143 of hollow spindle 142 is of enlarged diameter and is supported by anti-friction bearing 146 in an enlarged counterbore 122*c* formed in the bottom end of the stationary housing 122.

A gear box 150 is secured by a plurality of bolts 151 to the bottom face of stationary housing 122. The lower end of the rotatable spindle 142 projects into the gear box 150 and has a large diameter gear 152 secured thereto by a key 154 in conventional fashion. The gear box 150 extends laterally beyond the stationary housing 122 and a secondary housing 160 is secured thereto. Secondary housing 160 is of inverted cup-shaped configuration and the lower end thereof is secured by a plurality of bolts 161 to a cylindrical mounting ring 162 which in turn is secured by a plurality of bolts 163 to the gear box housing 150.

Mounting ring 162 defines a central cavity 162*a* for mounting an anti-friction bearing 165. The bottom wall of the gear box housing 150 also defines a cavity 150*a* for mounting an anti-friction bearing 166 in axial alignment with bearing 165. A shaft 170 is supported between the two bearings and is secured with fastener 173 to a small gear 172 which meshes with the large gear 152, hence shaft 170 is driven at a substantially higher rotational speed.

The upper portion of shaft 170 projects into the chamber 160*a* defined by the second housing 160 and a magnet mounting cage 180 is keyed to shaft 170 by key !81. Magnet mounting cage 180 is substantially identical to the magnet cage assembly 62 heretofore described with the exception that three axially spaced rows of magnets 182 are mounted in peripherally spaced relationship and in appropriate circumferentially spaced, radial apertures 183 (FIG. 3) formed in the periphery of the cage 180. Cage 180 is preferably fabricated of non-magnetic material. The magnets 182 are secured Within the cage 180 by a surrounding press fitted non-magnetic sleeve 184. Non-magnetic retainer sleeve 184 is disposed in close radial proximity to a cylindrical sleeve 185 formed of non-magnetic, electrically conductive material. Sleeve 185 is press fitted within the bore 190*b* of an inverted cup-shaped flux adjusting element 190, formed of ferromagnetic material, which is slidably mounted within the cavity 160*a* of the second housing 160. The axial sliding movement of the flux adjusting element 190 is provided by set screws 191 which cooperate with an axially extending groove 193 in the wall of element 190.

As before, the pole faces of the magnets 182 are alternated between north and south as the magnets progress around the circumference of the cage 180, as indicated on FIG. 3. Thus the flux generated by the magnets passes through the electrically conductive sleeve !85 and through the wall of the flux adjusting member 190. The rotation of the magnets 18 produced by the shaft 170 thus results in substantial eddy currents being generated in the stationary electrically conductive sleeve.

Adjustment of the flux adjusting member 190 is conveniently accomplished by a bolt 192 which is rotatably secured to the top wall 160*b* of housing 160 but secured against axial movement by a shoulder on bolt 192 and a manual adjustment knob 194 secured to the ends of adjusting bolt 192 by a transverse pin 196. The threaded bolt 192 cooperates with a threaded hole 195 in the base of the inverted cup-shaped, flux adjusting sleeve 190 and hence manual rotation of the bolt 192 will result in an axial displacement of the flux adjusting sleeve 190 and will substantially reduce the amount of magnetic flux passing through electrically conductive sleeve 185 as the flux adjusting member 190 is elevated.

In accordance with this invention, water leaking through the minimal bearing clearance provided between the top spindle portion 140 and the bore 126*b* of the seal element 126 is directed through a plurality of angularly and downwardly spaced ports 200 from which is sprays onto the exterior of the second housing 200, thus effecting a cooling of such housing to help absorb the heat generated in the electrically conductive sleeve 185 by the eddy currents resulting from the high speed rotation of the magnets 182. A seal washer 141 prevents downward flow of the leakage water along spindle portion 143.

The remainder of the structure shown in FIG. 2 is conventional and comprises a conventional spray head unit 210 which is secured to threads 142*c* formed on the bottom end of the rotating spindle 142. See U.S. Pat. 4,690,325 for example. The internal bore 142*d* of the spindle 142 communicates with radially extending passages 212 provided in the head 210 and such passages are in turn in communication with piping extending to radially spaced nozzle elements 220. The nozzle elements are angularly inclined so as to impart a reaction force on the rotatable spindle 142 causing it to rotate at a high speed and thus initiating the braking action of the magnetic assemblage mounted in the second housing 160.

The foregoing detailed description of the two preferred embodiments of this invention is to be clearly understood as given by way of illustration and example only, the spirit and scope of this invention being limited solely by the appended claims.

What is claimed and desired to be secured by letters patent is:

1. A high pressure fluid delivery assembly comprising first and second non-rotatable hollow housings;

means for mounting said first and second housings in axially parallel, adjacent relationship;

said first housing having a central chamber connectable to a source of high pressure liquid;

a rotatable spindle journaled in the housing and having a central fluid passageway in fluid communication with said central chamber of the housing and leading to at least one exit nozzle which in operation tends to rotate the spindle;

said second hollow housing having an enlarged upper cylindrical chamber communicating at its lower end with a smaller diameter bearing mounting hole;

a bearing in said bearing mounting hole;

a shaft journaled in said bearing;

a plurality of permanent magnets;

means for mounting said magnets on said shaft in a circular array;

an electrically conductive cylinder concentrically, stationarily mounted in close proximity to said circular array of magnets; and gearing means interconnecting said spindle and said shaft for rotating said shaft for rotating at a higher speed than said spindle.

2. The apparatus of claim 1 plus means in said first housing for diverting liquid from said central chamber of said first housing to cool said second housing.

3. The apparatus of claim 1 further comprising a sleeve of magnetic material snugly surrounding said electrically conductive cylinder; and adjustable means for axially shifting said sleeve relative to said permanent magnets to vary the amount of eddy currents generated in said electrically conductive sleeve.

4. The apparatus defined in claim 3 wherein said adjustable means comprises a rod journaled in the upper portion of said enlarged upper chamber for rotational movement about the axis of said upper cylindrical chamber but restrained against axial movement;

a transverse hub formed on one of said magnetic sleeve and said electrically conductive, non-magnetic cylinder and having internal threads coaxial with the axis of said cylindrical upper chamber; and external threads on said rod engageable with said internal threads of said transverse hub, whereby manual rotation of said rod adjusts the relative axial position of said magnetic sleeve and said permanent magnets.

5. A self-propelled high pressure fluid delivery assembly of the typing having a non-rotating housing with a central chamber connectable to a source of high pressure water, a rotatable spindle journaled in the housing and having a central fluid passageway in fluid communication with said central chamber of the housing and leading to at least one exit nozzle which in operation tends to rotate the spindle, comprising, in combination:

a plurality of permanent magnets;

means for supporting said plurality of magnets in a circular array for relation with the spindle within the housing;

an electrically conductive sleeve mounted concentrically inside the housing in close proximity to the rotational path of said magnets, wherein a magnetically generated force opposes rotation of said spindle and eddy currents generate head in said sleeve;

means defining a generally annular fluid passage surrounding said electrically conductive cylinder;

an annular seal mounted in said central chamber and defining an elongated bore; and said spindle having an elongated hollow stem portion rotatable in said seal bore with minimum clearance, whereby a minimal portion of the high pressure water will leak through said minimum clearance and flow into said generally annular fluid passage for diverting water from said central chamber to flow through said generally annular passage to cool said electrically conductive cylinder.

6. A self-propelled high pressure liquid delivery assembly of the type having a non-rotating hollow housing with a central chamber connectable to a source of high pressure liquid, a rotatable spindle journaled in the housing and having a central fluid passageway in fluid communication with said central chamber of the housing and leading to at least one exit nozzle which in operation tends to rotate the spindle, comprising, in combination:

a plurality of permanent magnets;

means for mounting said magnets in a circular array;

means operatively connected to said spindle for rotating said mounting means about the axis of said circular array;

an electrically conductive sleeve concentrically stationarily mounted in close proximity to said circular array of magnets;

an annular seal mounted in said central chamber and defining an elongated bore;

said spindle having an elongated hollow stem portion rotatable in said seal bore with minimum clearance, whereby a minimal portion of the high pressure liquid will leak through said minimum clearance; and fluid passage means in said housing for diverting said leaking liquid into heat removing relationship relative to said electrically conductive sleeve.

7. A self-propelled high pressure liquid delivery assembly of the type having a non-rotating hollow housing with a central chamber connectable to a source of high pressure liquid, a rotatable spindle journaled in the housing and having a central fluid passageway in fluid communication with said central chamber of the housing and leading to at least one exit. nozzle which in operation tends to rotate the spindle, comprising, in combination:

a plurality of permanent magnets;

a circular array of magnets are mounted on a shaft rotatably journaled in a second hollow housing mounted in parallel adjacent relationship to said first mentioned hollow housing;

gearing means for driving said shaft by said spindle at a speed higher than said spindle rotational speed, an electrically conductive sleeve concentrically stationarily mounted in close proximity to said circular array of magnets; and means for diverting liquid from said central chamber to cool said electrically conductive sleeve.

8. The apparatus of claim 7 wherein said means for diverting liquid comprises:

an annular seal mounted in said central chamber and defining an elongated bore;

said spindle having an elongated hollow stem portion rotatable in said seal bore with minimum clearance, whereby a minimal portion of the high pressure water will leak through said minimum clearance; and radial port means for directing said leakage water against said second housing to cool said electrically conductive sleeve.

* * * * *